United States Patent [19]

Stenhouse

[11] Patent Number: 4,481,980

[45] Date of Patent: Nov. 13, 1984

[54] DOUBLE DENT LIGHTWEIGHT REED CONSTRUCTION

[75] Inventor: William L. Stenhouse, Greenville, S.C.

[73] Assignee: Steel Heddle Manufacturing Co., Greenville, S.C.

[21] Appl. No.: 402,162

[22] Filed: Jul. 26, 1982

[51] Int. Cl.[3] ..... D03D 49/62

[52] U.S. Cl. ..... 139/192

[58] Field of Search ..... 139/188, 191, 192

[56] References Cited

U.S. PATENT DOCUMENTS

| | | | |
|---|---|---|---|
| 1,146,478 | 7/1915 | Coombs | 139/192 |
| 3,770,024 | 11/1973 | Pfarrwaller | 139/188 |

FOREIGN PATENT DOCUMENTS

| | | | |
|---|---|---|---|
| 284434 | 6/1914 | Fed. Rep. of Germany | 139/192 |
| 467307 | 3/1913 | France | 139/192 |
| 8525 | of 1825 | United Kingdom | 139/192 |
| 710 | of 1854 | United Kingdom | 139/192 |

*Primary Examiner*—Henry Jaudon

*Attorney, Agent, or Firm*—Julian W. Dority

[57] ABSTRACT

A reed A for a loom is disclosed which includes a front row B of dents 30 on the beat-up side of the frame and a back row C of dents 34 staggered in alignment with dents 30. An upper support bar D and lower support bar E support the dents 30, 34 in the reed. Upper support bar D includes mounting bars 42, 44 which are reduced in height compared to a main bar element 40 such that dents 34 have a greater free height in the reed than dents 30 rendering them more flexible. Upper support bar D which is on the free unclamped side of the reed during beat-up is thus rendered lighter than lower support bar E which is on the clamping side to reduce inertial loading on the frame. The front reed dents will offer a strong reed to the beat-up. Since the back reed is required only to separate the adjacent warp ends it is made as flexible as possible by increasing the height. In this way, the back reed offers less resistance to the yarn passage reducing the lint buildup between the dents and increase efficiency by offering a larger opening to the warp yarns.

5 Claims, 4 Drawing Figures

DOUBLE DENT LIGHTWEIGHT REED CONSTRUCTION

BACKGROUND OF THE INVENTION

The invention relates to a construction for a reed on a textile loom which spaces the individual warp ends on the loom and holds them parallel as the reed pushes the filling yarn into place at the fell of the fabric. As each pick of the filling yarn is inserted through the shed of the warp yarns, the reed beats up the filling yarn against the already woven part of the fabric in an action commonly referred to as beat-up. The reed typically includes a frame in which a plurality of wire dents are carried to provide spaces therebetween in which the warp yarn ends are guided. One side of the frame is clamped to a moving beam on the loom which moves the reed back and forth to produce the beat-up action. One side of the reed is commonly referred to as the beat-up side as it faces the fell of the cloth being woven. The wire dents are normally fairly rigid so that they may beat up the filling yarn against the fabric already woven.

The problem occurs that the warp yarns forming a shed for insertion of the filling yarn to pass often stick or cling together due to their close proximity to one another. This often results in breakages when the reed moves forward over the warp yarn ends during beat-up. Slubs, knots, and other imperfections in the individual warp yarn ends also tend to catch on the dents due to the narrow spacing therebetween which causes breakage of the warp yarn ends. Warp breaks result in time consuming loom stops or fabric imperfections, both of which are costly in terms of time and production.

Many types of cloth such as very fine fabrics, require a large number of warp yarn ends per inch of reed and it is difficult, if not impossible, to arrange the dents to provide a passage space for each warp end rendering paralleling of the warp ends difficult during shedding and beating-up.

In an attempt to more evenly space the warp yarn ends and hold them parallel as the reed beats up each pick of the filling yarn, the use of two rows of dents has been proposed whereby the front row beats the filling yarn against the woven fabric and the back row of dents are arranged to more evenly space the warp ends. Since there are more dents to hold the yarns parallel without a corresponding decrease in spacing distance the warp ends pass freely through the reed. In this manner, ends are spaced more evenly without construction of the passage spaces. Typical of the prior double dent reed constructions are those shown in U.S. Pat. No. 1,146,478, Dutch Pat. No. 2,823,222, and British Pat. No. 8,525.

However, it has been found that considerable resistance to the passing of the warp ends may still be had in the back row of dents due in part to their rigidity and their staggered path which requires the warp yarns to assume a somewhat tortuous path through the reed.

The prior constructions also tend to be heavier than single dent reeds which makes them less desirable for use on modern high speed looms. The inertial forces on the upper free side of the reed frame are considerable when utilized on high speed loom operations.

Accordingly, an important object of the present invention is to provide a double dent reed construction for a loom which permits the warp yarn ends to pass more freely through the dent spaces and reduces accumulation of lint and warp breakages.

Still another important object of the present invention is to provide a double dent reed construction for a loom which includes a first row of dents on the beat-up side of the reed which are rigid for beating-up the filling yarns and a second row of dents which are more flexible than the first row of dents which assist in holding the warp ends parallel yet facilitate free passage of the warp yarn ends through the dent spaces.

Still another important object of the present invention is to provide a double dent reed construction for a high speed loom in which the free side of the reed frame is lighter than the clamping side of the frame to reduce the inertial forces on the frame and loom during beat-up.

Yet another important object of the present invention is to provide a double dent reed construction for a loom which has a first and second row of staggered dents carried in the frame by means of upper and lower support bars wherein the upper support bar on the free side of the frame is lighter in weight than the lower support bar and by means of which the first row of dents are supported more rigidly in the frame for beating-up the filling yarns.

SUMMARY OF THE INVENTION

The above objectives are accomplished according to the present invention by means of a reed construction which includes a first row of dents on the beat-up side of the frame and a second row of dents on the warp beam side in which the dents are more flexible than the dents of the first row. The dents of both rows are carried in the frame by means of upper and lower support bars. The upper support bar includes a reduced height portion which mounts the second row of dents and renders them more flexibly supported in the frame than the dents of the first row due to their greater effective height in the frame. The upper support bar, which is also the free, unclamped side of the reed, is lighter than the lower support bar so that the inertial forces on the frame are reduced during beat-up. The lower support bar is provided with adequate structural strength for clamping on the lay beam of the loom by which the beat-up action is imparted to the reed. In a preferred embodiment, the upper and lower support bar members include longitudinal bar elements between which the ends are fixed by any suitable means such as the high strength thermosetting epoxy as disclosed in U.S. Pat. No. 3,189,056.

The front reed dents will offer a strong reed to the beat-up. Since the back reed is required only to separate the adjacent warp ends it is made as flexible as possible by increasing the height. In this way the back reed offers less resistance to the yarn passage reducing the lint buildup between the dents and increase efficiency by offering a larger opening to the warp yarns.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
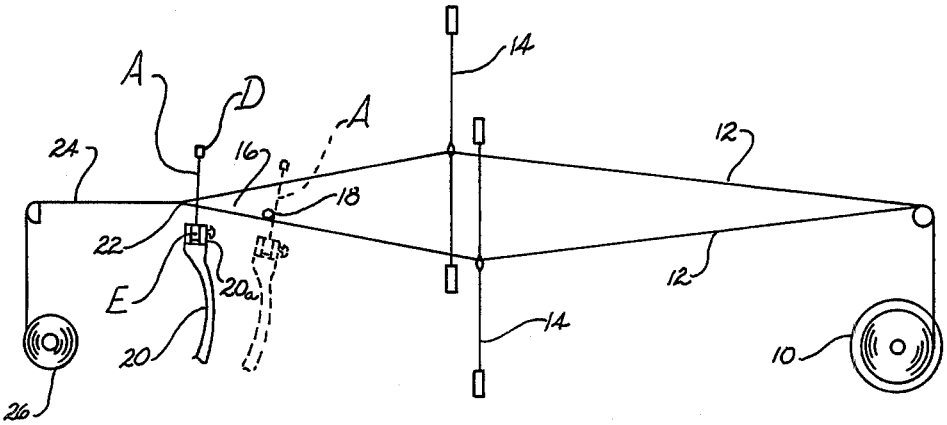
FIG. 1 is an elevation illustrating schematically the beat-up of a filling yarn on a textile loom by means of a reed.
Figure 2:
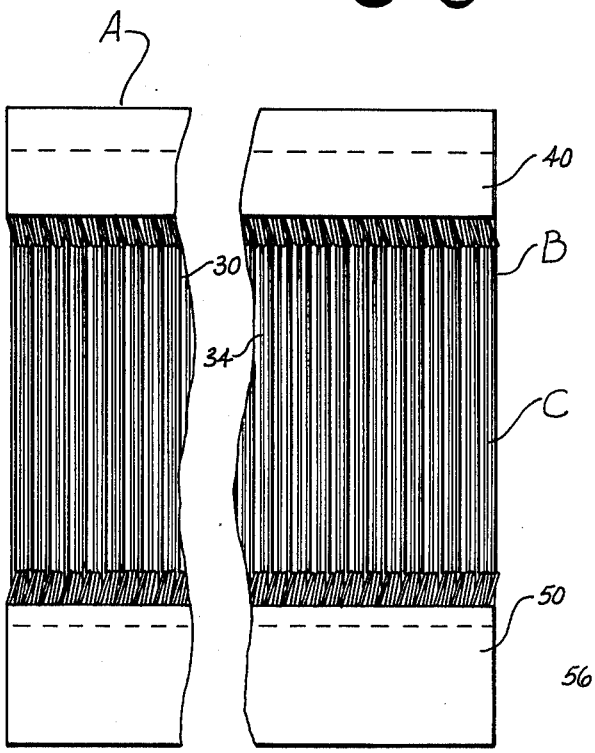
FIG. 2 is a front elevation of a double dent reed construction according to the present invention.
Figure 3:
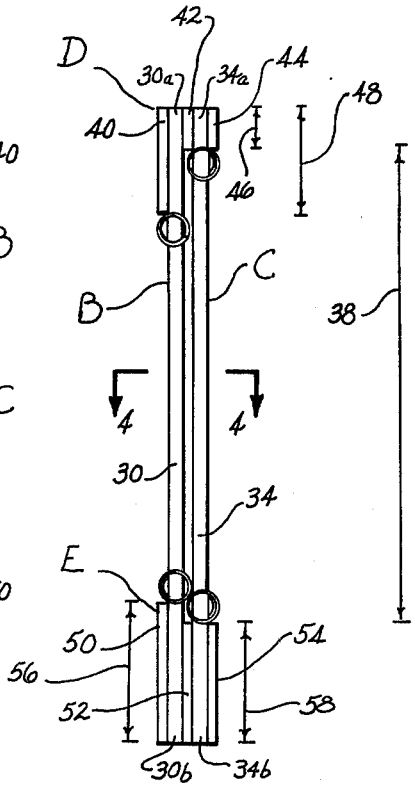
FIG. 3 is an end view of the double dent reed construction of FIG. 2.

The invention relates to a reed construction for a loom which beats the filling yarn against the already woven part of the fabric on the loom. Typically the loom includes a warper beam 10 on which a plurality of warp yarn ends 12 are carried which are raised and lowered on the loom by means of harnesses 14 to form a shed 16 in which a filling yarn 18 is inserted.

A reed A is carried on a movable lay beam 20 by means of a clamp 20*a* on the end of the lay beam. After the filling yarn 18 is inserted, the lay beam is moved forward to the full line position and the reed pushes the filling yarn 18 against the fell 22 of the woven part of the fabric 24 previously woven. The woven fabric is then taken up on a cloth roll 26.

Referring now in more detail to the drawing, a double dent construction for reed A is disclosed as including a first row B of dents which includes a plurality of dent wires 30 carried in the frame A in a side-by-side arrangement to define a plurality of dent spaces 32 therebetween through which the individual warp yarn ends 12 pass. The first row B of dents is illustrated on the beat-up side of the reed which is the side which beats the filling yarn against the already woven part of the fabric.

Figure 4:
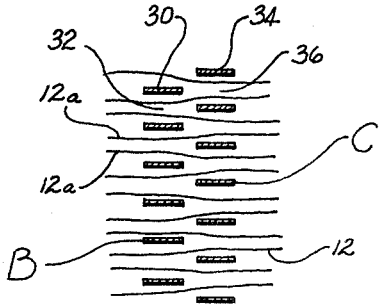
FIG. 4 is a sectional view taken along line 4—4 of FIG. 3.

A second row C of dents is carried in the frame behind the first row B of dents and includes a second plurality of wire dents 34 carried in a side-by-side arrangement behind the first row of dents. A second plurality of dent spaces 36 is defined between the dents 34 of the second row. As illustrated, the dents 34 of the second row are carried about midway between the dents of the first row in a staggered relation. Thus, a pair of warp yarns 12*a* (FIG. 4) pass together through spaces 32 in the first row of dents for beat-up but are evenly spaced in a parallel relationship by means of the staggered dents 34 in the preceding row of dents during shedding.

The remote ends 30*a* and 30*b* of the dents 30 of the front row B and remote ends 34*a* and 34*b* of dents 34 of the second row C are supported in the frame by means of upper support bar means D and lower support bar means E. As illustrated, the dents 34 of the second row C are supported in the frame so as to have an overall free height 38, the height excluding the affixed ends 34*a* and 34*b*, which is greater than the corresponding free height of the dents 30 of the first row B. This provides a more flexible mounting for the dents of the second row C and renders them more flexible in the frame so as to offer less resistance and more freely pass the warp yarns while maintaining them parallel. Flexible dents 34 will flex laterally more quickly and respond to the presence of knots or slubs in the warp yarns and to the tortuous path of warp yarn ends through the reed to reduce abrasion and breakage. Accumulation of lint is also reduced.

The front reed dents will offer a strong reed to the beat-up. Since the back reed is required only to separate the adjacent warp ends it is made as flexible as possible by increasing the height. In this way the back reed offers less resistance to the yarn passage reducing the lint buildup between the dents, and increases efficiency by offering a larger opening to the warp yarns.

As illustrated, the upper support bar means D which corresponds to the free side of the reed includes a first bar element 40 and a second bar element 42 between which the ends 30*a* of the dents 30 are fixed. The ends 34*a* of the dents 34 of the second row C are fixed between the second bar element 42 and a third bar element 44. The end of the dents may be affixed between the bar elements by any suitable means such as by bonding with a suitable thermoplastic adhesive such as illustrated in U.S. Pat. No. 3,189,056.

It will be noted that the third bar element 44 and the second bar element 42 have a lesser bar height 46 than the height 48 of the first bar element 40. This provides an increased height for the dents 34 and a more lightweight construction for the upper support bar means D than the lower support bar means E. With lower support bar E clamped in the clamping end 20*a* of the lay 20, a lighter free side of the frame will be provided which will produce reduced inertial loading and forces on the reed during beat-up. This renders the reed construction more desirable and suitable for use on high speed looms.

The lower support bar means E includes a first bar element 50, and a second longitudinal bar element 52 between which ends 30*b* of ends 30 are fixed. The ends 34*b* of the dents of the second row are fixed between the second bar element 52 and a third bar element 54. As illustrated, the first bar element has a height 56 only slightly greater than the height 58 of the second and third bar elements. Thus, the lower support bar is still strong enough for clamping and driving of reed A during beat-up.

Conventional spacer springs 60 may be utilized to assist in spacing the wire dents 34. Supporting end frame structure at the ends of the reed A may be provided as required.

In one embodiment, reed A was constructed with bar elements 40, 42, and 44 having a bar height of 19 mm (48), 10 m, and 8 mm (46), respectively. The height 56 of bar element 50 was 22 mm and the height 58 of bar elements 52 and 54 was 19 mm. This results in a free height 38 for dents 34 of approximately 78 mm and a free height for dents 30 of about 57 mm. Dent wires of 1 mm width and 2.3 mm were utilized.

Thus, it can be seen that an advantageous construction for a reed can be had for high speed looms wherein the free side of the reed frame is lighter than the clamping side of the reed frame whereby the inertial forces on the reed may be reduced to facilitate use on high speed looms. The free side of the loom is made lighter in such a manner that the second row C of dents are supported with increased flexibility in the frame so that less resistance is presented to the passages of the knots, slubs, and the warp yarn ends through the dent spaces. The flexibility of the second row of dents also reduces the accumulation of lint which often occurs in the dent spaces of more rigid dent constructions. The front row of dents B present a strong reed to push the filling yarn against the already woven part of the fabric on beat-up.

While a preferred embodiment of the invention has been described using specific terms, such description is for illustrative purposes only, and it is to be understood that changes and variations may be made without departing from the spirit or scope of the following claims.

What is claimed is:

1. A reed for beating-up a filling yarn at the fell of woven fabric on a textile loom of the type having a frame in which dent means is carried providing dent spaces through which individual warp yarn ends pass, said frame including an upper free side and a lower clamping side which is clamped on a lay beam of the loom by which the beat-up action is imparted to the reed, wherein the improvement comprises:

a first row of dents having a rectangular cross-section carried in said frame in side-by-side arrangement on a beat-up side of said frame to define a first plurality of dent spaces through which said warp yarn ends pass;

a second row of dents having a rectangular cross-section carried in said frame in side-by-side arrangement defining a second plurality of dent spaces through which said warp yarn ends pass;

said second row of dents being arranged in said frame behind said first row of dents;

said dents of said second row being more flexible than the dents of said first row offering less resistance and facilitating passage of said warp yarn ends more freely through the dent spaces with reduced breakage and line accumulation;

said upper free side of said reed frame is lighter in weight than said lower clamping side reducing the inertial forces on said frame during beat-up;

said dents of said second row have a greater free height than the corresponding free height of said dents of said first row in said frame rendering the dents of said second row more flexible in said frame than the dents of said first row.

2. The reed construction of claim 1 including support means for supporting said dents of said second row of dents in said frame rendering said dents more flexible in said frame than said dents of said first row.

3. The reed construction of claim 1 including upper and lower support means carrying said first and second row of dents in said frame, said upper support means including bar means having a lesser height supporting said dents of said second row than said dents of said first row so that said dents of said second row have a greater free height and are supported more flexibly in said frame.

4. A reed construction for a textile loom comprising:

a frame having an upper bar means and a lower bar means;

a plurality of dents carried in said frame in a side-by-side arrangement defining predetermined dent spaces therebetween through which warp yarn ends pass on said loom;

said dents having opposing ends affixed in said upper and lower bar means;

said lower bar means providing a clamping side of said frame by means of which said frame is clamped on a lay beam on said loom for movement during beat-up of a filling yarn on said loom;

said upper bar means defining a free side of said frame during beat-up, said upper bar means being reduced in weight compared to said lower bar means thereby lowering the inertial forces on said reed frame during beat-up facilitating higher loom speed operation;

said plurality of dents including a first row and second row of dents carried behind said first row in staggered relation;

said upper and lower bar means including a first, second and third longitudinal bar element, said ends of said dents of said first row being affixed between said first and second bar elements and said ends of said dents of said second row of dents being affixed between said second and third bar elements; and the height of said second and third bar elements of a least said upper bar means is less than that of said first bar element rendering said dents of said second row of dents more flexible than the dents of said first row while providing a more lightweight upper free frame side.

5. A reed construction for a textile loom comprising:

a frame having an upper bar means and a lower bar means;

a plurality of dents carried in said frame in a side-by-side arrangement defining predetermined dent spaces therebetween through which warp yarn ends pass on said loom;

said dents having opposing ends affixed in said upper and lower bar means;

said lower bar means providing a clamping side of said frame by means of which said frame is clamped on a lay beam on said loom for movement during beat-up of a filling yarn on said loom;

said upper bar means defining a free side of said frame during beat-up, said upper bar means being reduced in weight compared to said lower bar means thereby lowering the inertial forces on said reed frame during beat-up facilitating higher loom speed operation;

said bar means of said upper free side of said frame having a reduced height compared to the height of said bar means of said lower clamping frame side; and said upper bar means including a first bar portion by means of which ends of said first dents of said first row are affixed and a second bar portion by which said dents of said second row are affixed, said second bar portion having a height less than that of said first bar portion so that said dents of said second row have a greater free height in said frame rendering said dents of said second row more flexible than the dents of said first row and said upper free side lighter in weight than said lower clamping side.

* * * * *